US005240156A

United States Patent [19]

Sicotte et al.

[11] Patent Number: 5,240,156

[45] Date of Patent: Aug. 31, 1993

[54] MODULAR COMPONENT SYSTEM

[76] Inventors: Louis T. Sicotte, 3107 Kingsridge Blvd., Boulder, Colo. 80301; Vernon L. Morris, 1208 Atwood, Longmont, Colo. 80502

[21] Appl. No.: 829,392

[22] Filed: Feb. 3, 1992

[51] Int. Cl.[5] ..... A45F 4/00

[52] U.S. Cl. ..... 224/151; 224/148; 224/224; 224/240; 224/901

[58] Field of Search ..... 224/901, 224, 148, 151, 224/240; 2/DIG. 6; 66/194; 24/445

[56] References Cited

U.S. PATENT DOCUMENTS

| | | | |
|---|---|---|---|
| 3,624,686 | 11/1971 | Beals | 2/DIG. 6 |
| 4,714,096 | 12/1987 | Guay | 24/445 |
| 4,819,846 | 4/1989 | Hannemann | 224/240 |
| 4,848,624 | 7/1989 | Clem | 224/901 |
| 4,881,383 | 11/1989 | Spillane et al. | 66/194 |
| 4,953,765 | 9/1990 | Little et al. | 224/224 |
| 4,957,231 | 9/1990 | Kalisher | 224/253 |
| 5,045,979 | 9/1991 | Stevens | 224/224 |

*Primary Examiner*—Linda J. Sholl

*Attorney, Agent, or Firm*—Dorr, Carson, Sloan and Peterson

[57] ABSTRACT

A modular system of interchangeable compartments mounted on a support member. The support member, such as a belt or vest, includes a support surface portion formed of a continuously looped, brushed polyester weave material. The outer surface is smooth and will not accidently snag other surfaces. Compartment modules, provided in a variety of shapes and sizes according to the activity in which the modular system is to be used, include at least one fastening strip of upstanding hook elements. The upstanding hook elements are able to engage the continuously looped brushed polyester weave to secure the compartment modules onto the support surface portion of the modular system. The compartment modules can be attached to the support surface in any desired position as well as any angular orientation by simply pressing the fastening strips onto the support surface. The compartment modules are easily removed from the support surface by forcibly disengaging the fastening strips from the support surface. Thus, the modular system can be easily reconfigured as necessary for a variety of activities.

2 Claims, 4 Drawing Sheets

MODULAR COMPONENT SYSTEM

BACKGROUND OF THE INVENTION

1. Field of the Invention

This invention relates to the field of compartment component systems, particularly to modular belt pack systems.

2. Statement of the Problem

Belt packs, such as fanny packs, are widely utilized in ever increasing activities, such as running, hiking, skiing, skating and the like. The use of these packs allow the user to carry equipment, clothing, food, water and other supplies without the inconvenience of a full-sized back pack.

These belt packs normally consist of a one to two inch belt having a small pack stitched onto the belt. These packs may include several zippered compartments. Some earlier belt packs also include water bottle holders stitched directly onto the belt.

There presently are no practical belt pack systems that provide for freely interchangeable compartments on a belt. The user is limited to the existing compartments which may not be sufficient for every need or which may be superfluous for a desired activity. For instance, a user may desire a small compartment for one activity so as not to be constricted, while needing a larger compartment for another activity. Additionally, a user may desire water bottles for a strenuous activity which may not be necessary with another activity.

Another problem with existing belt pack systems is the rigid orientation of the compartments. Typically, the compartments are secured onto the belt so that the user must unbuckle the belt or rotate the pack in order to access the compartment. There are no known products at this time that will allow the user to secure compartments on the belt in any desired position and orientation to improve the access to the compartment or increase the comfort to the user.

Thus, a problem exists in prior art pack systems in the lack of selection, interchangeability, or rearrangability of modular components and with the rigid orientation of compartments. Additionally, even if there had been removable compartments in the past pack systems, these typically would have been attachable by snaps, belts, zippers, VELCRO or the like. All of these attachment devices are limited solutions as to the above describe problem as well as relatively expensive and heavy attachment devices. The simply has been no effective solution to the above-described problem prior to the present invention.

3. Solution to the Problem

The present invention solves this problem and others by providing a modular compartment pack system.

The modular compartment pack system of the present invention provides a belt with a plurality of interchangeable and rearrangeable compartment modules for selective use in the differing activities of the wearer.

The modular compartment pack system of the present invention provides a belt utilizing modular compartments secured thereon in various positions and orientations.

The modular compartment pack system of the present invention provides a belt having a component support surface that is substantially smooth.

The modular compartment pack system of the present invention provides the ability to reconfigure the modular pack system in a multitude of configurations.

These and other features of the present invention are disclosed in the ensuing description of the invention and in the drawings.

SUMMARY OF THE INVENTION

The present invention provides a modular system of interchangeable compartments mounted on a support member. The support member, such as a belt or vest, includes a support surface portion for attaching the compartment modules. This surface portion includes an outer surface material formed of a continuously looped, brushed polyester weave. The outer surface material is laminated onto an open cell foam backing which is laminated onto a light breathable, polyester/nylon material. This provides a lightweight, flexible support surface which will conform to the body shape of the wearer to provide an ergonomic fit. The outer surface is smooth and will not accidentally snag other surfaces or objects.

The compartment modules are provided in a variety of shapes and sizes according to potential activities for which the modular system may be used. In the preferred embodiment, the compartment modules include a small compartment module for holding keys, money, and identification, a large compartment module for holding equipment, clothing and food, a compartment module for holding a portable stereo and a water bottle compartment module.

Each of the compartment modules include at least one fastening strip of upstanding hook elements. The upstanding hook elements are able to engage the continuously looped brushed polyester weave material of the support surface portion to secure the compartment modules onto the support surface portion of the modular system.

The compartment modules can be attached to the support surface portion in any desired position as well as any angular orientation by simply pressing the fastening strips onto the support surface. The compartment modules are easily removed from the support surface by forcibly disengaging the fastening strips from the support surface. Thus, the modular system can be easily reconfigured as necessary for a variety of activities.

These and other features of the present invention are disclosed in the description of a preferred embodiment and in the drawings.

BRIEF DESCRIPTION OF THE DRAWINGS

FIG. 1(*a*) is a front perspective of the modular compartment pack system of FIG. 1(*a*).

DETAILED DESCRIPTION OF A PREFERRED EMBODIMENT

The present invention provides a modular system of interchangeable compartments mounted on a support member, such as a belt pack or vest. This system allows the support member to be reconfigured with a variety of different compartment modules as desired according to the activity undertaken. The different compartment modules can be individually selected and mounted in various positions and orientations.

A preferred embodiment of the present invention is illustrated in FIGS. 1-4. It is to be expressly understood that the present invention is not limited by the descriptive embodiment which is provided for explanatory purposes only. Other embodiments and variations are considered to be within the scope of the inventive concept.

Figure 1A:
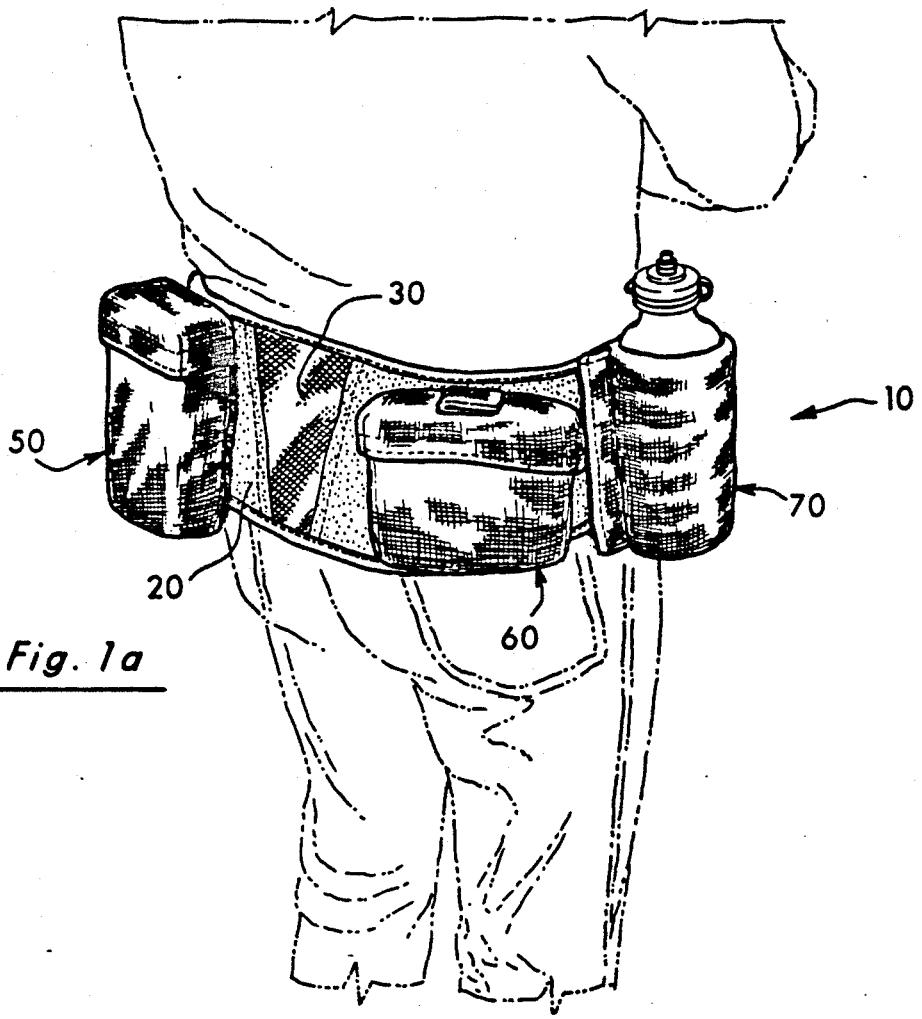
FIG. 1(*a*) is a rear perspective of a preferred embodiment of the modular compartment pack system of the present invention.
Figure 1B:
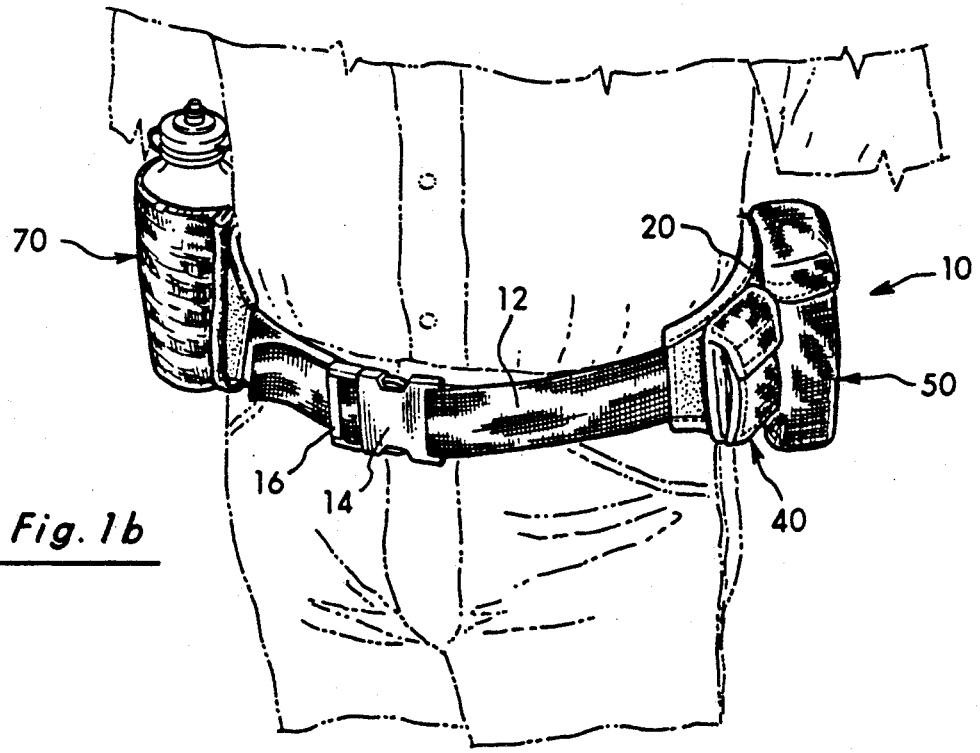

The preferred embodiment illustrated in FIG. 1(*a*) is shown as fanny pack system 10. Fanny pack system 10 includes belt 12, shown in FIGS. 1(*b*) and 2, which can be formed from nylon, canvas, leather or other similar materials. Fasteners 14, 16 are secured on each free end of belt 12 to allow the fanny pack system to be fastened around the waist of the person using the system. The length of belt 12 can be easily adjusted through fasteners 14, 16 as is well known in the art.

Support Member

Figure 2:
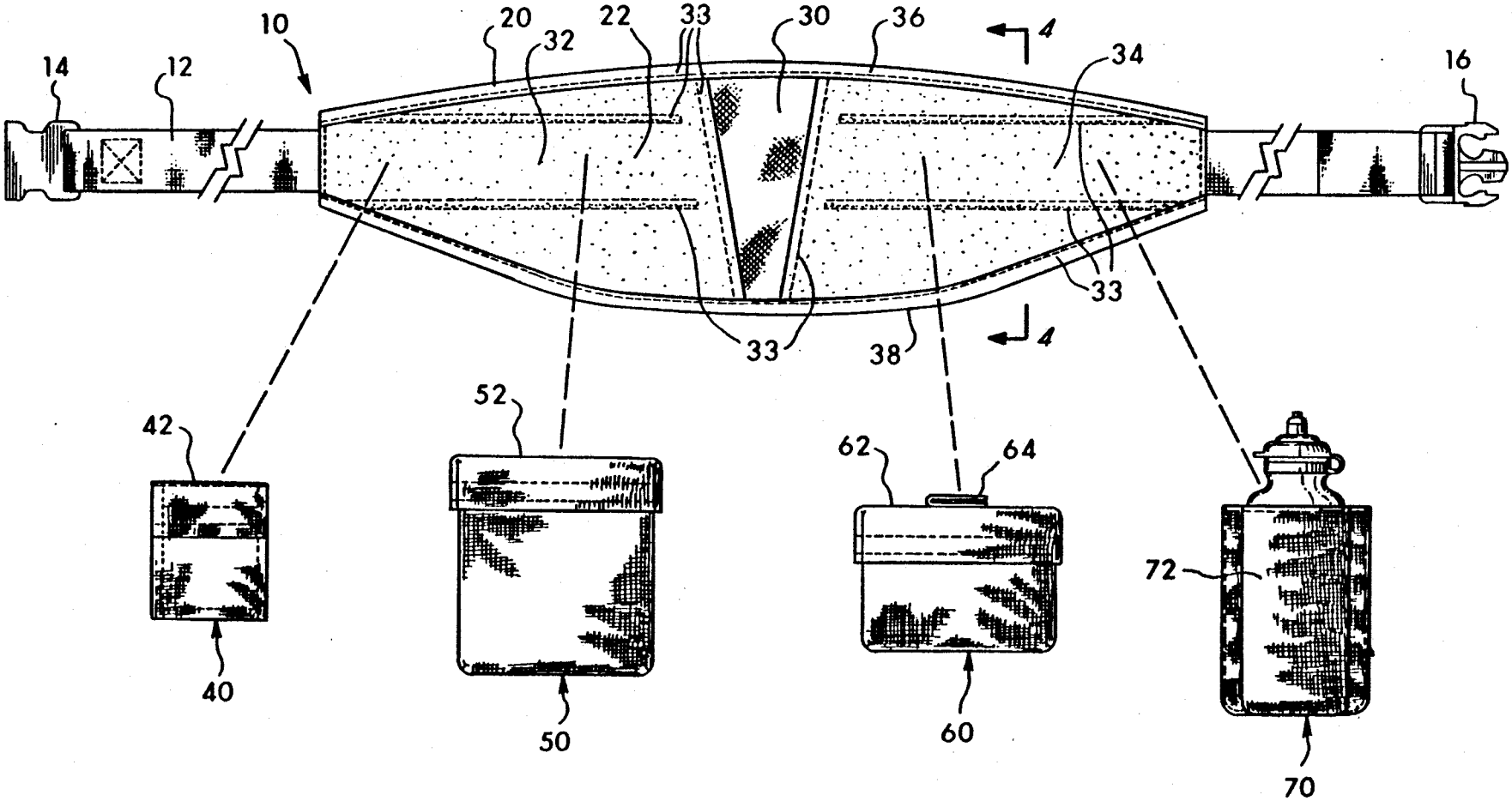
FIG. 2 is a front flat exploded view of the modular compartment pack system of FIG. 1(*a*).
Figure 4:
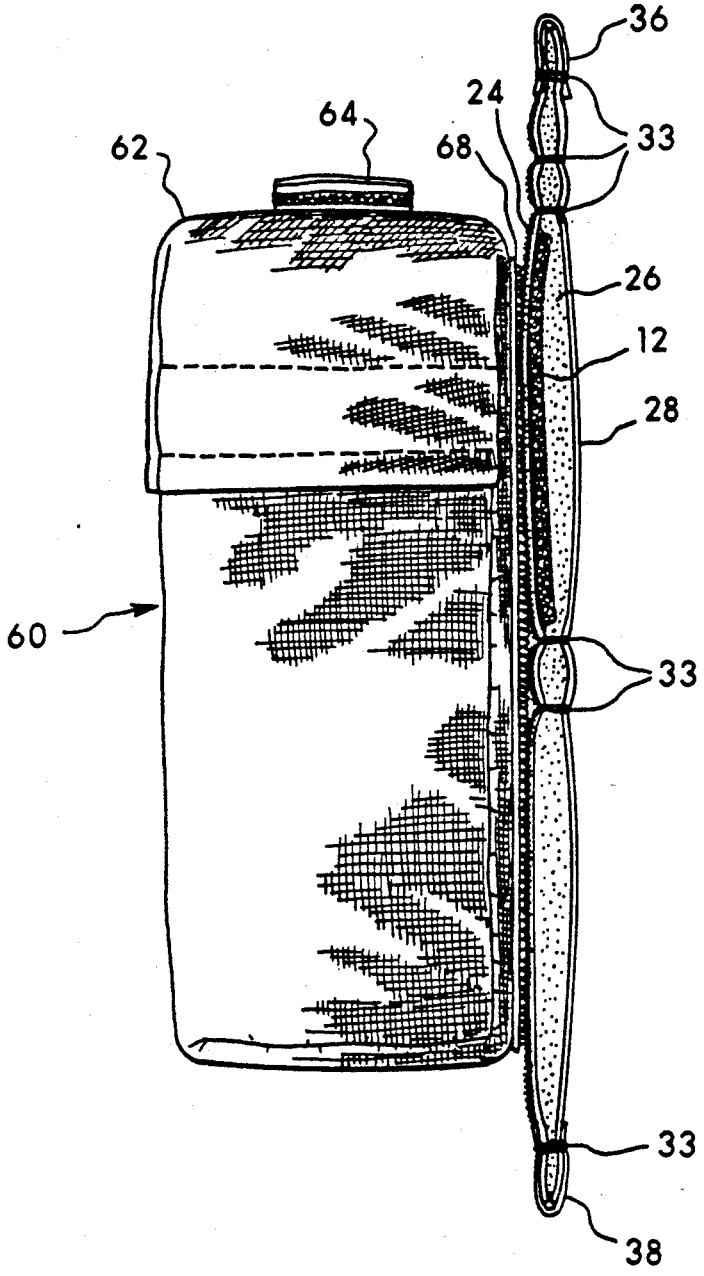
FIG. 4 is a cross-sectional view of the compartment support of the modular compartment pack system of FIG. 1(*a*).

Support member 20, as shown in FIG. 2, has a substantially smooth surface 22 on which modules such as compartments 40, 50, 60, 70 are attached. Surface 22 is formed of a material known under the trademark TEMPO which are commercially available. The surface material 24, as shown in FIG. 4, includes continuously looped brushed polyester weave. This material, although known for other uses, has not been used prior to the present invention as a securing surface for modular components on a be it system as discussed below. Other materials having similar characteristics, as discussed below, may be used as well. Surface material 24 is then laminated onto open cell foam backing 26. Belt 12 may be interposed in this area as well for securing support member 20 onto belt 12. Foam backing 26, in the preferred embodiment, is about one-eighth inch thick. While foam material is disclosed, any suitable padding material could also be utilized. Foam backing 26 is then laminated onto tricot backing 28. Tricot backing 28 is a light breathable polyester/nylon backing. While tricot is preferred in the present embodiment, other suitable materials may be used as well.

The continuously looped brushed polyester weave 24 provides a smooth surface which will not engage fabrics or snag on unwanted objects. Although providing a smooth surface, continuously looped brushed polyester weave material of outer surface 24 has been discovered to have the unique capability of engaging upstanding hook elements, such as the male fastening hook elements of VELCRO fasteners, manufactured by Velcro, Industries, B.V., Amsterdam, Netherlands. Normally, the male fastening hook elements of VELCRO are used with female fastening elements of VELCRO which are formed of a plurality of generally parallel spaced apart non-overlapping, upstanding monofilamentary loop elements. These loop elements typically only engage the hook elements in limited orientations and also form a rough surface which snag fabric threads and other unwanted attachments. However, the hook elements engage the continuously looped brushed polyester weave material of surface material 24 in any orientation. Additionally, as discussed above, continuously looped material 24 provides a smooth surface which will not engage in unwanted attachment with other objects. The continuously looped brushed polyester weave material is also less expensive and lighter weight when compared with VELCRO fasteners. Other materials having similar characteristics may be usable under the inventive concept of the present invention.

Figure 3:
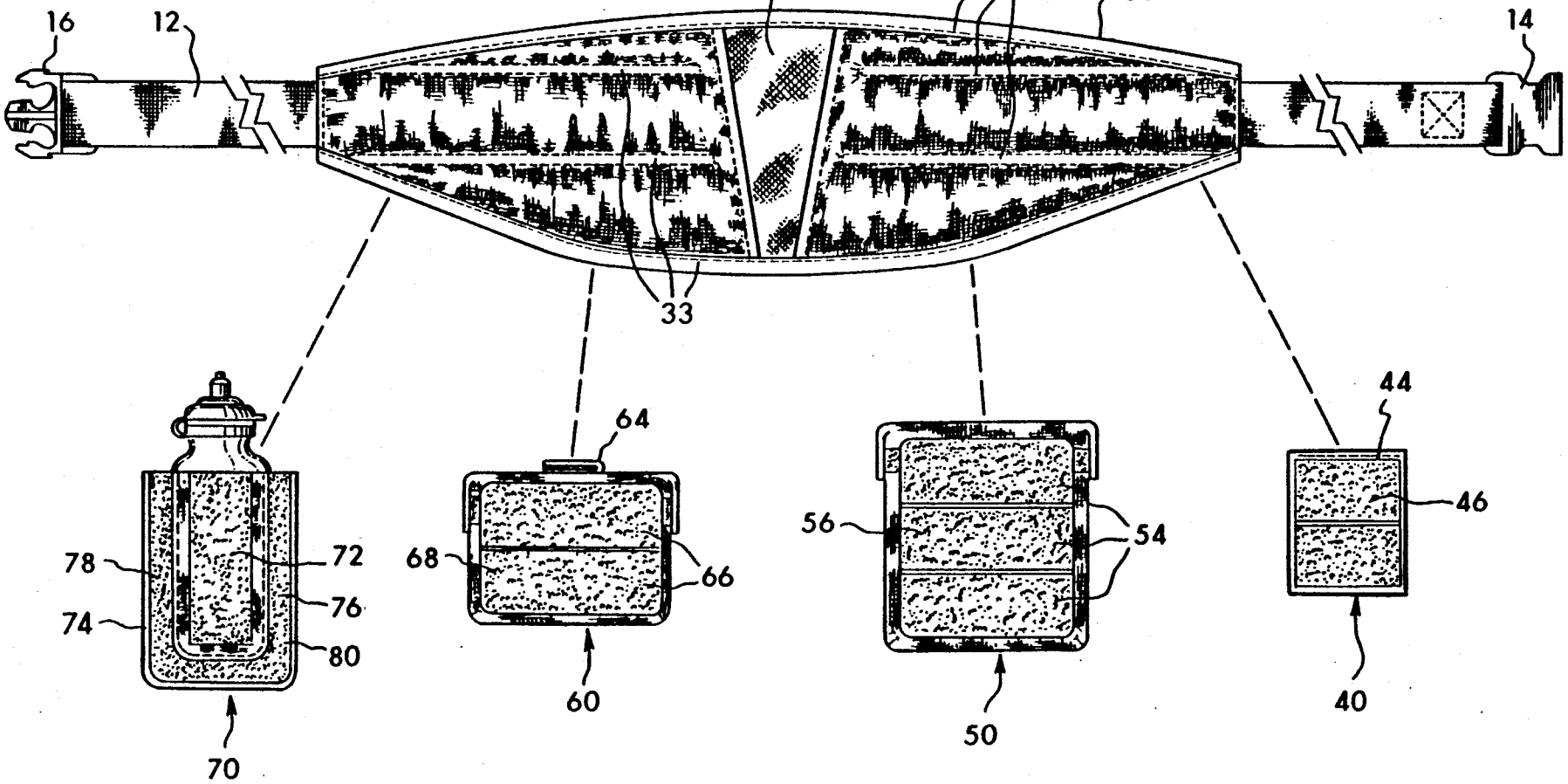
FIG. 3 is a rear flat exploded view of the modular compartment pack system of FIG. 1(*a*).

As shown in FIGS. 2 and 3, open webbing 30 is inserted in the center of support member 20 to provide ventilation. This feature allows the lower back of the wearer of pack system 10 to ventilate to prevent perspiration from occurring. Open webbing 30 separates support member into two defined regions 32, 34 on which the compartment modules, discussed below, are secured. Trim 36, 38, such as nylon, canvas or another durable material, is stitched around the perimeter of support member 20 to prevent ripping or tearing of the edges of surface material 24, foam backing 26 or tricot backing 28. Trim 36, 38, open webbing 30, surface material 24, foam backing 26, tricot backing 28 and belt 12 are stitched together at seams 33 to form an integral support member. Support member 20 is flexible to conform to the body shape of the person wearing it for an ergonomic fit. This allows system 10 to be usable in a variety of activities without constricting the wearer in undertaking various activities.

It is to be expressly understood that the support member 20 is configured to be part of a pack system in FIG. 1. However, support member 20 can be suitably configured to be in any geometric pattern for any desired application whether in clothing, accessories or other applications.

MODULES

A variety of modules are illustrated in FIGS. 2 and 3. The present invention is not meant to be limited to the illustrated compartment module which are shown for explanatory purposes only. Other shapes and configurations are contemplated under the claimed inventive concept, such as, for example, first aid kits, map holders, rope holders, and the like.

Compartment module 40 is dimensioned to hold small items, such as house keys, car keys, identification and the like. Module 40 includes fold over top 42 with hook and loop fasteners (not shown), such as the aforesaid VELCRO. On the rear side of module 40 (shown in FIG. 4) is fastening strip 44 formed of upstanding hook elements 46, such as the male fastening elements of VELCRO. Fastening strip 44 securely attaches module 40 onto surface 22 by the engagement of upstanding hook elements 46 with continuously looped material of surface material 24.

Compartment module 50 is dimensioned to hold larger objects, such as binoculars, clothing, food or other large items. Module 50 also includes fold over top 52 which includes VELCRO fasteners (not shown). On the rear side of module 50 (shown in FIG. 4) are fastening strips 54 formed of upstanding hook elements 56. Fastening strips 54 securely attaches module 50 onto surface 22 by the engagement of upstanding hook elements 56 with continuously looped material of surface material 24.

Compartment module 60 is dimensioned to hold a portable stereo with headphones. Module 60 includes fold over top 62 having VELCRO fastening elements (not shown) and top flap 64 having VELCRO fastening elements (not shown). Top flap 64 is provided to secure the headphone wire to prevent snagging or flapping. The headphones can also be secured to module 60 by top flap 64 when not in use. The rear side of module 60

(shown in FIG. 4) is also provided with fastening strip 66 formed of upstanding hook elements 68. Fastening strip 66 securely attaches module 60 onto surface 22 by the engagement of upstanding hook elements 68 with continuously looped material of surface material 24.

Compartment module 70 is dimensioned to snugly receive a standard sized water bottle in compartment 72. Module 70 includes backing flange 74 which is wider than the compartment 72. Fastening strips 76, 78 (shown in FIG. 3) having upstanding hook elements 80 are secured onto backing flange 74 to be spaced apart a distance greater than the width of compartment 72. Fastening strips 76, 78 securely attaches module 70 onto surface 22 by the engagement of upstanding hook elements 80 with continuously looped material of surface material 24. The spacing of fastening strips 76, 78 provide a stronger attachment of module 70 with support member 10 to reduce the possibility of module 70 accidently disengaging from surface 22.

FIGS. 2 and 3 show four distinct modules. It is to be expressly understood than any number of modules could be utilized under the concept of the present invention.

Configuring the Modular System

Modular system 10 allows the wearer to configure the system as desired for a variety of activities. Depending on the desired activity, the wearer can select appropriate compartment modules. The selected compartment modules can then be attached onto surface 22 in regions 32, 34 of support member 20. Mounting the compartment modules onto surface 22 as surface 22 is flat prior to wearing provides the best results, although the compartment modules can be easily rearranged while the modular system is worn.

The compartment modules can be placed in any position on regions 32, 34 of support member 20 as well as any angular orientation. For instance, compartment module 70 may be placed near an end of surface 22 and at an angle to allow the wearer to easily access the water bottle contained in module 70 without moving or detaching belt 12.

The compartment modules are easily removed from modular system 10 by simply grasping the compartment module and forcibly pulling the compartment module from support member 20 to disengage the upstanding hook elements from continuously looped material of surface material 24.

The modular compartment component system of the present invention can be used in any convenient configuration such as in a vest form by forming or attaching portions of the vest with the continuously looped brushed polyester weave as described above. Appropriate compartment modules having upstanding hook element strips can then be attached to these portions. The modular compartment component system can also be used for applications other than recreational or sporting uses, such as in a tool belt form, to provide compartment modules for tools and supplies. Other contemplated uses and configurations include medical first aid kits, cellular telephone compartment modules, telecommunication device compartment modules, notepad compartment modules, map case compartment modules as well as others that would be obvious to those skilled in the art.

The present invention provides a modular compartment component system having broad usage in a multitude of embodiments and environments. The above description of a preferred embodiment is meant for explanatory purposes and is not meant to limit the scope of the claimed inventive concept.

We claim:

1. A modular compartment component belt for providing interchangeable and reconfigurable compartments on a belt, said modular compartment component belt comprising:

a belt, fasteners affixed on each end of said belt for securing said belt onto a wearer;

a support member having at least two defined regions affixed to said belt; each of said at least two regions including:

a tricot backing portion;

an open cell foam backing laminated onto said tricot backing portion; and a substantially smooth surface portion formed of continuously looped brushed polyester weave material laminated onto said open cell foam backing;

an open web ventilation area interposed between said two defined regions for providing ventilation between said two defined regions; and a plurality of compartment modules having various shapes and sizes, each of said plurality of compartment modules including:

a rear surface; and at least one portion on said rear surface having a plurality of upstanding hook elements for engagement with said continuously looped brushed polyester weave for attachment onto one of said two defined regions on said support member.

2. The modular compartment component belt of claim 1 wherein said plurality of compartment components include:

at least one compartment module having a compartment;

a backing flange extending wider than said compartment; and at least two portions on said backing flange having upstanding hook elements, each of said at least two portions extending parallel to one another and spaced a distance greater than the width of said compartment.

* * * * *